US008336617B2

(12) United States Patent
Knobloch et al.

(10) Patent No.: US 8,336,617 B2
(45) Date of Patent: Dec. 25, 2012

(54) DOWNHOLE FILTER TOOL

(75) Inventors: Benton Knobloch, Lafayette, LA (US); Todd Roy, Youngsville, LA (US); David J. Tilley, Franklin, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/350,551

(22) Filed: Jan. 13, 2012

(65) Prior Publication Data

US 2012/0111558 A1 May 10, 2012

Related U.S. Application Data

(63) Continuation of application No. 13/163,359, filed on Jun. 17, 2011, now abandoned, which is a continuation of application No. 12/669,128, filed as application No. PCT/US2009/043527 on May 12, 2009, now abandoned.

(60) Provisional application No. 61/052,373, filed on May 12, 2008.

(51) Int. Cl.
*E03B 3/18* (2006.01)

(52) U.S. Cl. ..... 166/205; 166/227; 166/99; 175/314

(58) Field of Classification Search ..... 166/227, 166/205; 175/314
See application file for complete search history.

(56) References Cited

U.S. PATENT DOCUMENTS

2002/0162655 A1* 11/2002 Lynde et al. ..... 166/99

OTHER PUBLICATIONS

*M-I, LLC* v. *Chad Lee Stelly, et al.*, In the United States District Court for the Sourthern District of Texas, Houston Division, C.A. No. 4:09-CV-01552, Third Amended Complaint (Exhibits A-G were designated Attorney Eyes Only at time of filing and have been removed), Sep. 7, 2010.

*M-I, LLC* v. *Chad Lee Stelly, et al.*, In the United States District Court for the Southern District of Texas, Houston Division, C.A. No. 4:09-CV-01552, Answer and Counterclaims to Plaintiff's Third Amended Complaint, Jan. 28, 2011.

*M-I, LLC* v. *Chad Lee Stelly, et al.*, In the United States District Court for the Southern District of Texas, Houston Division, C.A. No. 4:09-CV-01552, Order of Dismissal with Prejudice, Jun. 28, 2012.

* cited by examiner

*Primary Examiner* — Kenneth L Thompson
*Assistant Examiner* — Yong-Suk Ro
(74) *Attorney, Agent, or Firm* — Booth Albanesi Schroeder LLC; Scott Wendorf; John F. Booth

(57) ABSTRACT

Apparatus for downhole filtration of fluids in a wellbore. The apparatus has a diverter and a filter slidably mounted on a mandrel. The diverter has a circumferential wiper element between the mandrel and the casing within which the apparatus is run. When fluids are reverse circulated, or the tool is being pulled out, the diverter shifts to a downward position, wherein it seals against an upper end of the filter, filtering out solids in the fluids and retaining them in a chamber between the sleeve and mandrel. When running the tool into a wellbore, the diverter shifts to an upper position to permit fluids to bypass the filter sleeve. The filter sleeve bears against a spring loaded seat, which permits creating a gap between the diverter and an upper end of the filter sleeve to allow fluids to bypass the filter sleeve should the filter sleeve slots become plugged.

17 Claims, 7 Drawing Sheets

DOWNHOLE FILTER TOOL

CROSS REFERENCE TO RELATED APPLICATIONS

This patent application is a continuation of U.S. patent application Ser. No. 13/163,359, filed Jun. 17, 2011, now abandoned which is a continuation of U.S. patent application Ser. No. 12/669,128, filed Jan. 14, 2010, now abandoned, which is a 371 of PCT/US09/43527, filed May 12, 2009, which claims priority to U.S. Provisional Patent Application Ser. No. 61/052,373, filed May 12, 2008, for all purposes.

BACKGROUND

1. Field of the Invention

This invention relates to apparatus used to in connection with the servicing of wellbores (namely, those of oil and gas wells), including the treatment of fluids in the wellbore, including but not limited to "clear" (that is, non-solids bearing) completion fluids in the wellbores, solids-bearing drilling muds, or any other fluids. More specifically, this invention relates to an apparatus run downhole on a workstring, which catches solids (including not only solids from drilling muds, debris such as cement, milled up downhole tools, but solids remaining from drilling mud, etc.) entrained in the fluids and permits removal of the solids from the wellbore.

2. Related Art

In the drilling and completion of oil and gas wells, a number of situations arise in which solids are present in the wellbore fluid, and removal of the solids is necessary. As an example, during the drilling and/or completion of a well, with drilling mud (that is, solids-bearing drilling mud), solids such as cement particles, pieces of downhole equipment which have been drilled and/or milled, junk lost in the hole, etc. may become present in the mud. Some way to remove such solids is necessary, or at a minimum desired.

In other situations, certain types of oil and gas well completions depend on the use of a solids-free (or as nearly solids free as possible) completion fluid. Such completion fluids, sometimes referred to as completion brines, for example calcium bromide, have densities higher than that of fresh water, due to the salts dissolved therein. Gravel pack completions are an example of a well completion procedure which requires the use of clear completion fluids. In the typical sequence of drilling and completing a well, the drilling of the well generally utilizes drilling mud, which is solids laden. Once the drilling is complete and completion casing is run, the drilling mud is displaced from the wellbore, and a clear completion fluid placed in the wellbore. Some solids from the drilling mud invariably end up in the completion fluid, e.g. from a layer of mud on the interior of the casing string, from surface tanks, etc. It is important to remove as many of such solids as possible, because the completion efficiency of the well can be seriously and adversely impacted if solids remain in the completion fluid. For example, a gravel pack completion can be partially, if not completely, plugged by solids entrained in the completion fluid. As a result, there exists an incentive to clean completion fluids to the greatest extent possible, by removing as many solids as possible.

Therefore, regardless of the type of fluid in a wellbore, it may become desirous to remove solids entrained therein. Various apparatus and methods have been developed in the past to do so, however the prior art apparatus and methods known to applicants have various limitations. The present invention seeks to address such limitations and provide an effective means to trap and remove solids from wellbore fluids.

DESCRIPTION OF THE PRESENTLY PREFERRED EMBODIMENT(S)

The present invention comprises a downhole filter tool, to be run into a wellbore (whether run on a tubular string, coiled tubing, wireline, or by any other means), the wellbore being filled with a fluid (whether same be a solids laden fluid such as a drilling mud, or a relatively solids free fluid such as a clear completion fluid), to provide the following non-exclusive functions:

1. Wipe the inner surfaces of tubulars, risers, or any similar surfaces, collectively referred to herein as casing, thereby removing mud film, solid contaminants or similar materials from the surfaces.
2. Collect wellbore solids or contaminants entrained in the wellbore fluids, by filtering or straining fluid through a filter sleeve when pulling the tool from the wellbore.
3. Provide a means for positive retention of wellbore fluid solids or contaminates remaining in the wellbore, so that same may be brought to the surface and disposed of.

Figure 1:
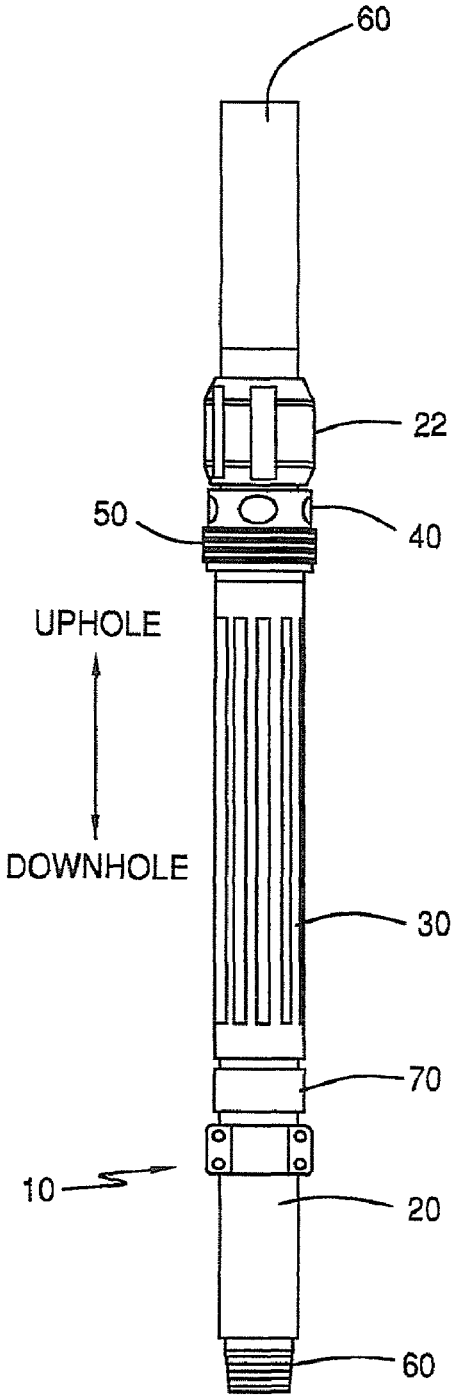
FIG. 1 is a side view of the filter tool of the present invention.
Figure 2:
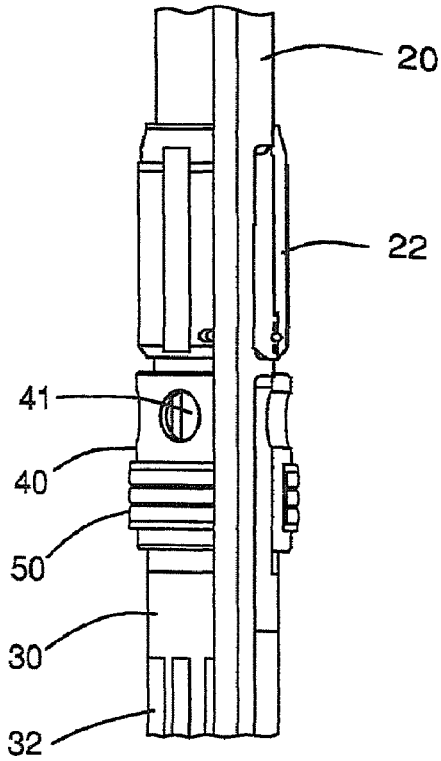
FIG. 2 is a more detailed view of one section of the tool.
Figure 3:
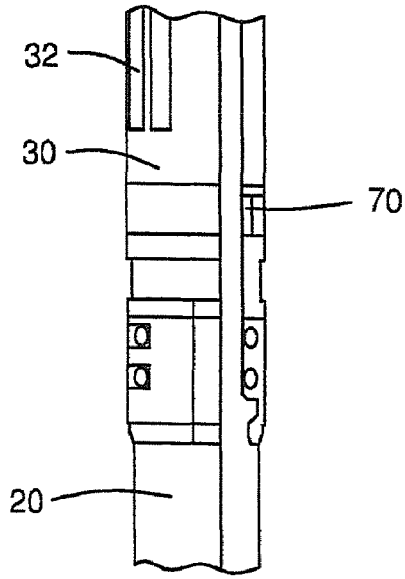
FIG. 3 is a more detailed view of another section of the tool.

It is to be understood that the preferred embodiment will be described with the tool in its typical orientation in a wellbore, as noted in FIG. 1, with "Downhole" pointing toward the bottom of the wellbore, and "uphole" in the opposite direction (i.e. toward the surface). It is to be further understood that placement of a structural element "below" another structural element means in the downhole direction, namely a position closer to the bottom of the wellbore; "above" means the opposite. "Upper" means in a direction opposite to the downhole direction, "lower" means in the downhole direction.

Figure 4:
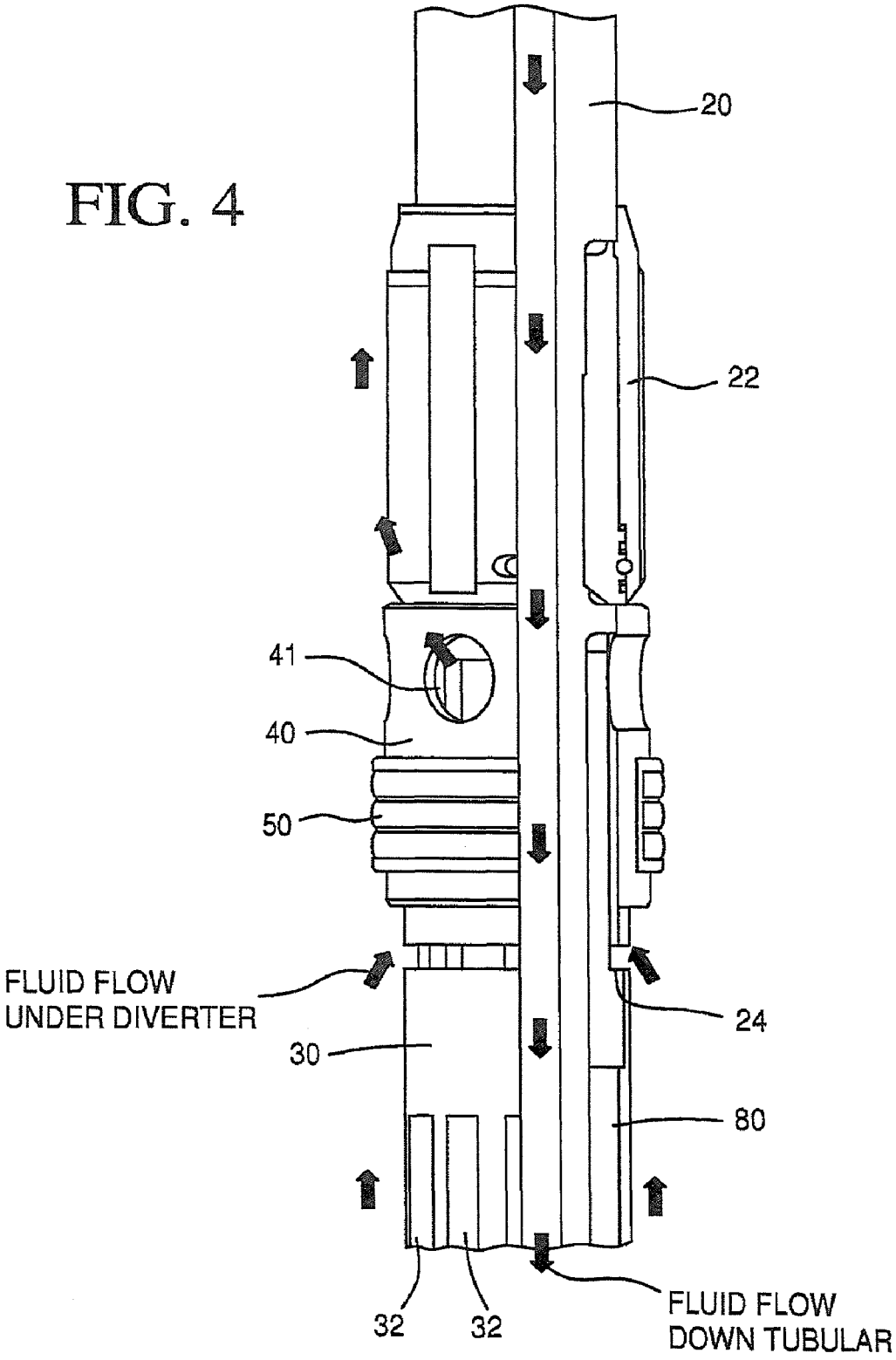
FIG. 4 is a view showing fluid flow in an upward direction relative to the tool.
Figure 5:
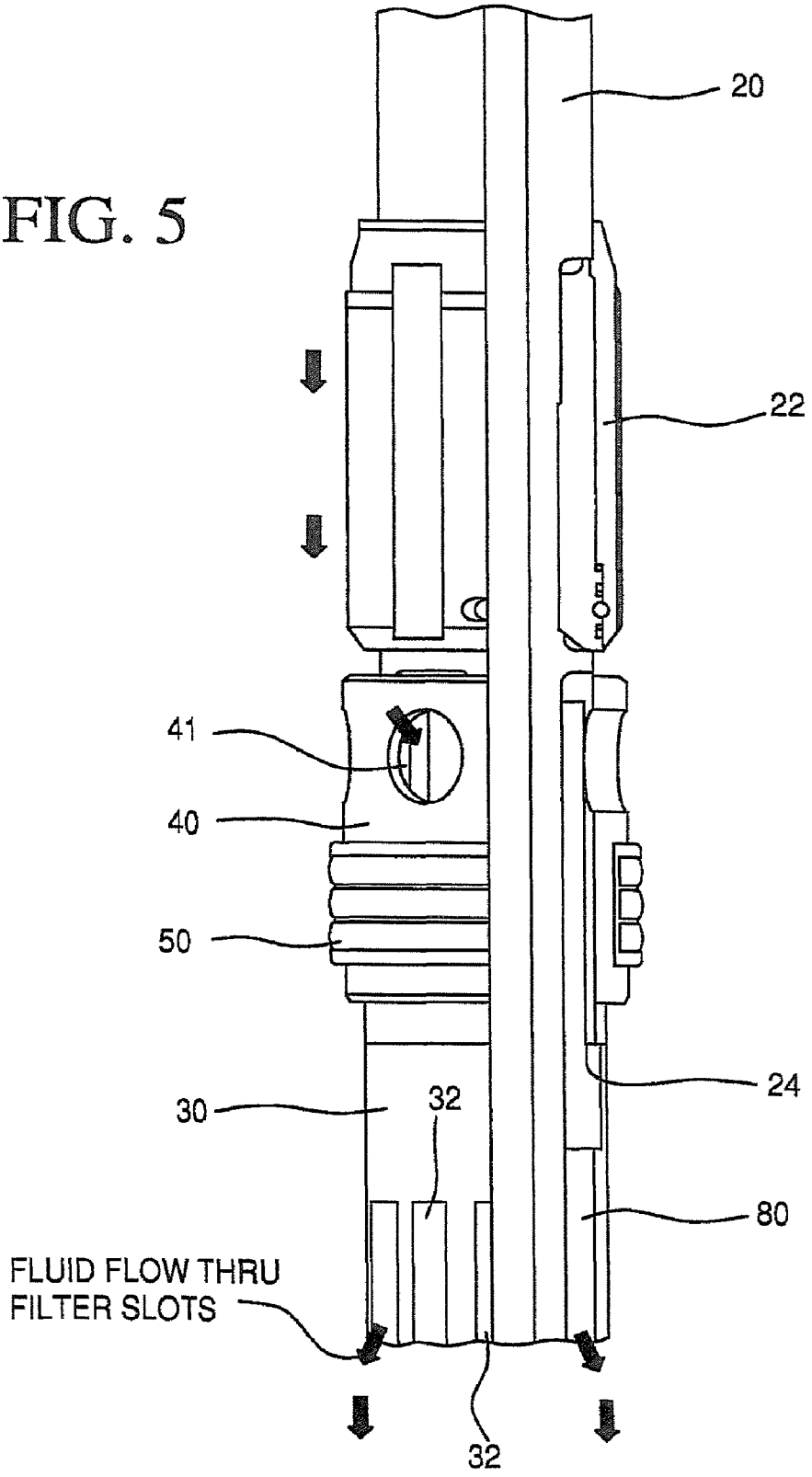
FIG. 5 is a view showing fluid flow in an downward direction relative to the tool.

With reference to the drawings, one presently preferred embodiment will now be described. As can be seen in FIGS. 1-5, downhole filter tool 10 comprises a central body or mandrel 20. Mandrel 20 has under-cut profiles or outer diameter variations, designed to allow outer assemblies (for example, stabilizer 22, described later) to be slid over the mandrel and secured, retained or locked into position, as can be seen in FIGS. 4 and 5. By way of example of such outer assemblies, mandrel 20 preferably has stabilizer 22 mounted thereon. Outer assembly, in this case stabilizer 22, may be removably mounted on mandrel 20, and interchangeable for other outer assemblies such as scrapers and the like. Yet another alternate outer assembly is a tapered mill sleeve, useful to ensure any solids, debris or contaminates of the like encountered can be downsized if back-reaming or rotation is required to get out of the hole.

A filter sleeve 30 is slidably mounted on mandrel 20. Filter sleeve 30 comprises fluid filtering openings therein, for fluid flow through filter sleeve 30, and can take various forms, but in the preferred embodiment is a slotted sleeve. Filter sleeve 30 provides a robust filtering device, in the preferred embodiment the fluid filtering openings comprise slots 32, which may be sized as desired depending upon the particular application, to allow fluid flow through filter sleeve 30 while filtering and retaining larger solids within chamber 80 (described below). Alternatively, the fluid filtering openings in filter sleeve 30 may comprise gaps, ports or the like to permit fluid flow through filter sleeve 30 and provide a means for filtering out solids in the fluids. In the preferred embodiment, filter sleeve 30 is free to rotate with respect to the mandrel and can be constructed of various material such as stainless steel, high carbon steel, aluminum, synthetics or the like. In practice, filter sleeve 30 slides over mandrel 20, and is supported internally by radial stabilizer ribs integral to the mandrel. As mentioned previously, the fluid filter openings (slots 32) in filter sleeve 30 may be slots, holes, or other shaped openings, and may be sized so as to provide optimum filtering for a given situation (i.e. expected solids size). Slots 32 in filter sleeve 30 may also be oriented at right angles to the longitude of the filter sleeve.

A diverter 40, which is a generally cylindrical member, is disposed around and movable on mandrel 20, its movement generally limited in an uphole direction by outer assembly, namely stabilizer 22, and in a downhole direction by contact either with an upper end of filter sleeve 30 or a shoulder 24 on mandrel 20. As such, diverter 40 is movable between an upper position (bearing against outer assembly) and a lower position (bearing against upper end of filter sleeve 30, and/or against a shoulder 24 on mandrel 20). Further, in the preferred embodiment, diverter 40 may rotate around mandrel 20, so that diverter 40 may remain rotationally stationary while a drill string is rotated within it. As is shown in the drawings, diverter 40 is positioned above filter sleeve 30. In most operating situations, filter sleeve 30 remains longitudinally fixed with respect to mandrel 20 (except in the bypass situation described later herein).

A wiper 50 is mounted on the outer circumference of diverter 40. It is to be understood that wiper 50 may take various forms. For example, wiper 50 may be of a resilient synthetic material, so as to press relatively tightly against the interior wall of a casing string (even though wiper 50 may not provide a fluid seal therebetween). Alternatively, wiper 50 may comprise a brush, of steel or synthetic bristles, which may serve a function as a brush or scraper against the casing wall, in addition to generating some drag force. A brush embodiment may permit diverter to pass through restricted diameters yet still contact the casing wall. Generally, wiper 50 provides some resistance to fluid flow, so as to tend to redirect fluid through diverter 40, and also to provide a means to move diverter 40 upward or downward. The relatively large cross section area presented by wiper 50 means that even small fluid flow rates will provide sufficient pressure differential across wiper 50 to move diverter 40 upward and downward.

It is to be understood that a relatively close fit between wiper 50 and the casing inner diameter also provides a drag force (wiper 50 tending to remain in one place unless pushed or pulled by movement of filter tool 10), needed for proper operation of the tool. Movement of diverter 40 to its lower position generally occurs when filter tool 10 is being pulled in an uphole direction through the fluid column within the wellbore, or when reverse circulating (it being understood that movement of diverter 40 in an upward direction occurs in the opposite situation). As stated above, the movement of diverter 40 on mandrel 20 is limited in a downward (with respect to mandrel 20) direction by a shoulder 24 on mandrel 20, and in an upward (with respect to mandrel 20) direction by outer assembly, namely stabilizer 22. As can be readily seen in the drawings, diverter 40 comprises a plurality of fluid passages 41, of relatively large flow area, disposed above wiper 50.

As is common in the relevant industry, in one presently preferred embodiment mandrel 20 has threads 60 on either end, in order that it can be made up into a tubular string (for example, a tubing work string, or drillpipe string) and run downhole into a wellbore. However, it is to be understood that filter tool 10 may alternatively be run into and out of a wellbore on coil tubing, wireline, or by any other means known in the art.

Figure 6:
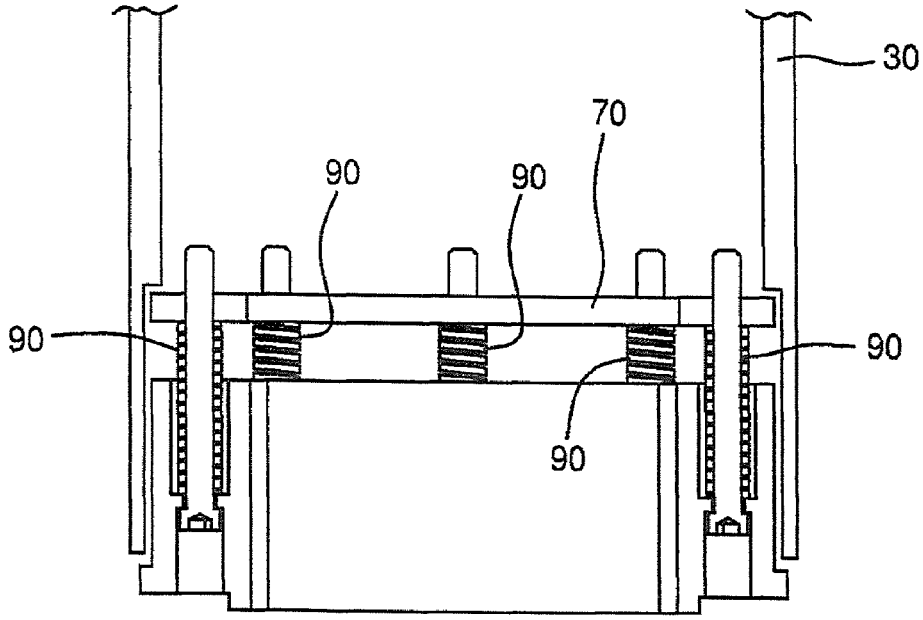
FIGS. 6 and 7 are views of the spring biased filter sleeve seat, in two (upper and lower) positions.

A filter sleeve seat 70 controls the downward movement of filter sleeve 30 with respect to mandrel 20. Seat 70 can be seen in FIGS. 1 and 3, and in detail in FIGS. 6 and 7. As is later described, seat 70 is biased in an uphole direction by springs 90, but can move in a downhole direction when sufficient force is exerted on seat 70 by filter sleeve 30, thereby creating a gap and a fluid passage between the upper end of filter sleeve 30 and diverter 40. This attribute is important when the solids collection chamber 80 between filter sleeve 30 and mandrel 20 becomes full of captured solids and debris.

Operation of the Filter Tool

A description of operation of a preferred embodiment of filter tool 10, in its two exemplary and primary operating modes, will serve to further explain the various above-described components and how said components integrate with one another.

Mode 1: Non-filtering (e.g., Running into a Wellbore or Forward Circulating)

With particular reference to FIG. 4: in this mode, fluid is moving in an uphole direction relative to filter tool 10, and moving by filter tool 10 without being filtered. This relative fluid direction occurs either when filter tool 10 is being run downhole into a fluid-filled wellbore on a tubular string, or when the tool is stationary and "forward" fluid circulation is occurring (i.e. fluid circulation down the tubular string and back uphole through the tubular string/casing annulus). With no countering forces acting on diverter 40, diverter 40 is moved toward its upper position by fluid forces bearing against wiper 50 and/or by drag on the casing wall as filter tool 10 is run downhole (or as fluid is being circulated uphole in the annulus). Therefore, as filter tool 10 moves downhole through the wellbore fluid, the resistance to fluid flow by wiper 50 (even though a positive seal or barrier to fluid flow does not exist) tends to cause fluids to instead pass around the outer diameter of filter sleeve 30, through the annulus between mandrel 20 and diverter 40, out of fluid passages 41 (which are relatively large, and permit solids to pass through and get above filter tool 10, later to be captured therein) in diverter 40, and back into the annulus between filter tool 10 and the casing string. In addition, with movement of filter tool 10 downhole, wiper 50 drags on the inner diameter of the casing into which the tool is being run, further tending to move wiper 50 and hence diverter 40 toward its upper position. Again, the relatively large cross sectional area of wiper 50 means that very small pressure differentials across it will induce movement of diverter 40 up or down. The arrows in FIG. 4 illustrate the direction of fluid flow.

Mode 2: Filtering (e.g., Pulling Out of Wellbore or Reverse Circulating)

With particular reference to FIG. 5: in this mode, fluid is moving in an downhole direction relative to filter tool 10, and is forced through slots 32 in filter sleeve 30 and thereby filtered. This relative fluid direction occurs either when filter tool 10 is being pulled out of a fluid-filled wellbore on a tubular string, or when filter tool 10 is stationary and "reverse" fluid circulation is occurring (i.e. fluid circulation down the tubular string/casing annulus and back uphole through the tubular string).

Diverter 40 is moved to its lower position by fluid movement downwardly relative to filter tool 10, and/or by drag forces on wiper 50 and diverter 40 (the wiper dragging on the casing inner diameter) as filter tool 10 is moved uphole. Diverter 40 moves downward so as to seal against the upper end of filter sleeve 30. Wiper 50 seals the annulus between diverter 40 and the inner wall of the tubular within which the apparatus is run. Therefore, as filter tool 10 moves uphole through the wellbore fluid, the fluid cannot pass by wiper 50. Instead, fluid moving downwardly with respect to the tool is therefore forced through fluid passages 41 in diverter 40, through the annulus between mandrel 20 and diverter 40, into chamber 80 between mandrel 20 and filter sleeve 30, through slots 32 in filter sleeve 30, and finally back into the annulus between filter sleeve 30 and the casing string. As is readily appreciated, as the fluid passes through slots 32 in filter sleeve 30, any entrained solids are filtered out and remain in chamber 80. By this function, with the tool at an initial downhole position, pulling filter tool 10 uphole through the fluid column forces the entirety of the fluid volume (that is, from the initial tool position uphole) through slots 32 in filter sleeve 30, thereby filtering out substantially the entire fluid column volume.

Depending upon the volume of fluid so filtered, and upon the volume of entrained solids being filtered out, the possibility arises of collection chamber 80 becoming completely full of solids, and in fact blocking fluid flow through slots 32. That situation gives rise to the possibility of a "swabbing" or fluid lock situation taking place, since all of the fluid is being pushed to pass through the slots, yet the slots are blocked. This situation is akin to attempting to remove the plunger of a syringe from the barrel, when the volume of fluid within the syringe barrel is being held constant.

Figure 7:
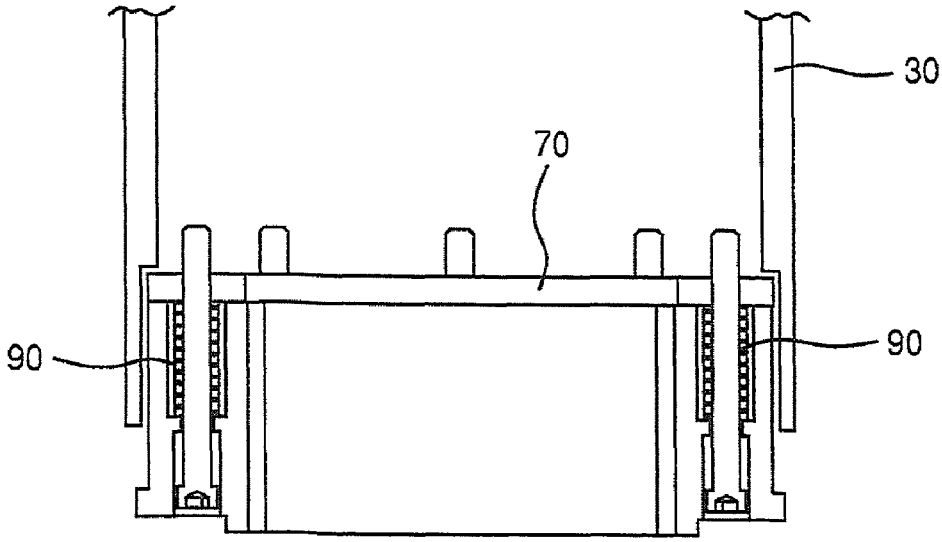
Figure 8:
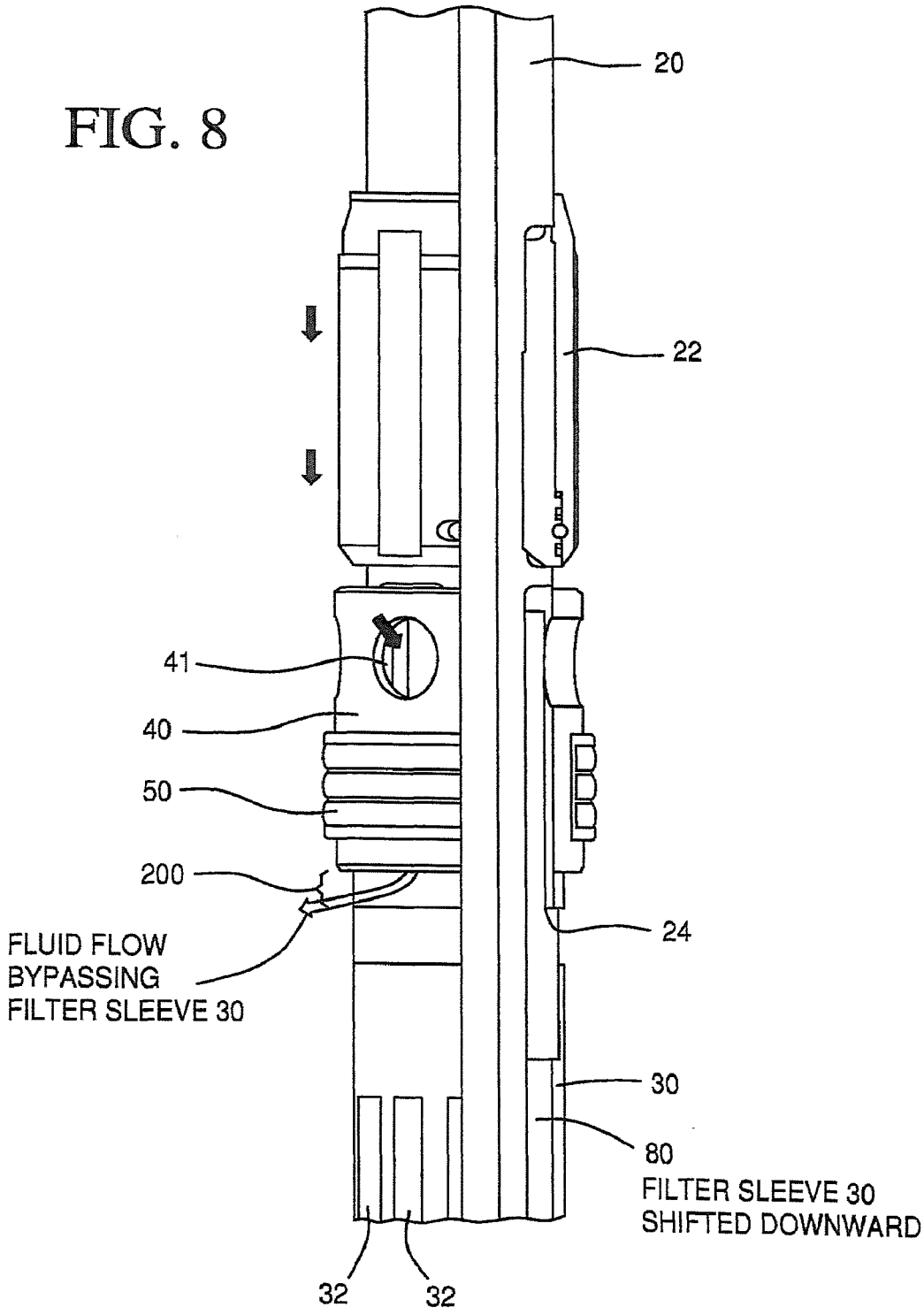
FIG. 8 is a view of the filter tool in partial cross section, with the filter sleeve shifted to a downward (lower) position and fluid bypassing the filter sleeve.

The present invention comprises a feature which obviates that problem. As mentioned above, filter sleeve 30 rests on seat 70, which is normally spring biased toward an upward position as in FIG. 6, thereby pushing sleeve 30 upward. When the swabbing situation described above occurs, it can be appreciated that the forces on filter sleeve 30, downward in relation to mandrel 20, become high. Those forces push sleeve 30 in a downhole direction, from an upper position to a lower position, overcoming the forces of springs 90 on seat 70, and move seat 70 and therefore filter sleeve 30 downward with respect to mandrel 20. FIG. 7 shows the downward (compressed) position of seat 70. As can best be seen in FIG. 8, diverter 40, as previously described, is limited in its downward movement by shoulder 24 on mandrel 20; therefore, when diverter 40 contacts shoulder 24, and has therefore reached the terminus of its movement, and as sleeve 30 and seat 70 continue to move downward, a gap 200 opens between diverter 40 and the upper end of sleeve 30. This gap allows fluid flowing under diverter 40 to simply flow back into the filter sleeve/casing annulus through the gap, thereby by-passing filter sleeve 30, as shown in FIG. 8. As can be understood, this bypass feature prevents the swabbing effect described above, and allows filter tool 10 to be readily withdrawn from the wellbore even if chamber 80 becomes full of solids and fluid flow through filter sleeve 32 is blocked.

Secondary Fluid Bypass System

In the presently preferred embodiment, filter tool 10 comprises a secondary fluid bypass system, described below. In certain circumstances, wherein filter sleeve 30 would otherwise move downwardly with respect to mandrel 20 (as in the above-described situation, with forces on filter sleeve 30 sufficient to move seat 70 downward, thereby opening a by-pass gap 200 between diverter 40 and filter sleeve 30), filter sleeve 30 becomes jammed and cannot move longitudinally with respect to mandrel 20. This situation may occur for various reasons, for example when chamber 80 accumulates a large volume of solids, or due to damage to filter sleeve 30, etc. Regardless of cause, in this situation the piston effect above described may occur, to the detriment of the operation and possibly further damaging the apparatus.

Figure 9:
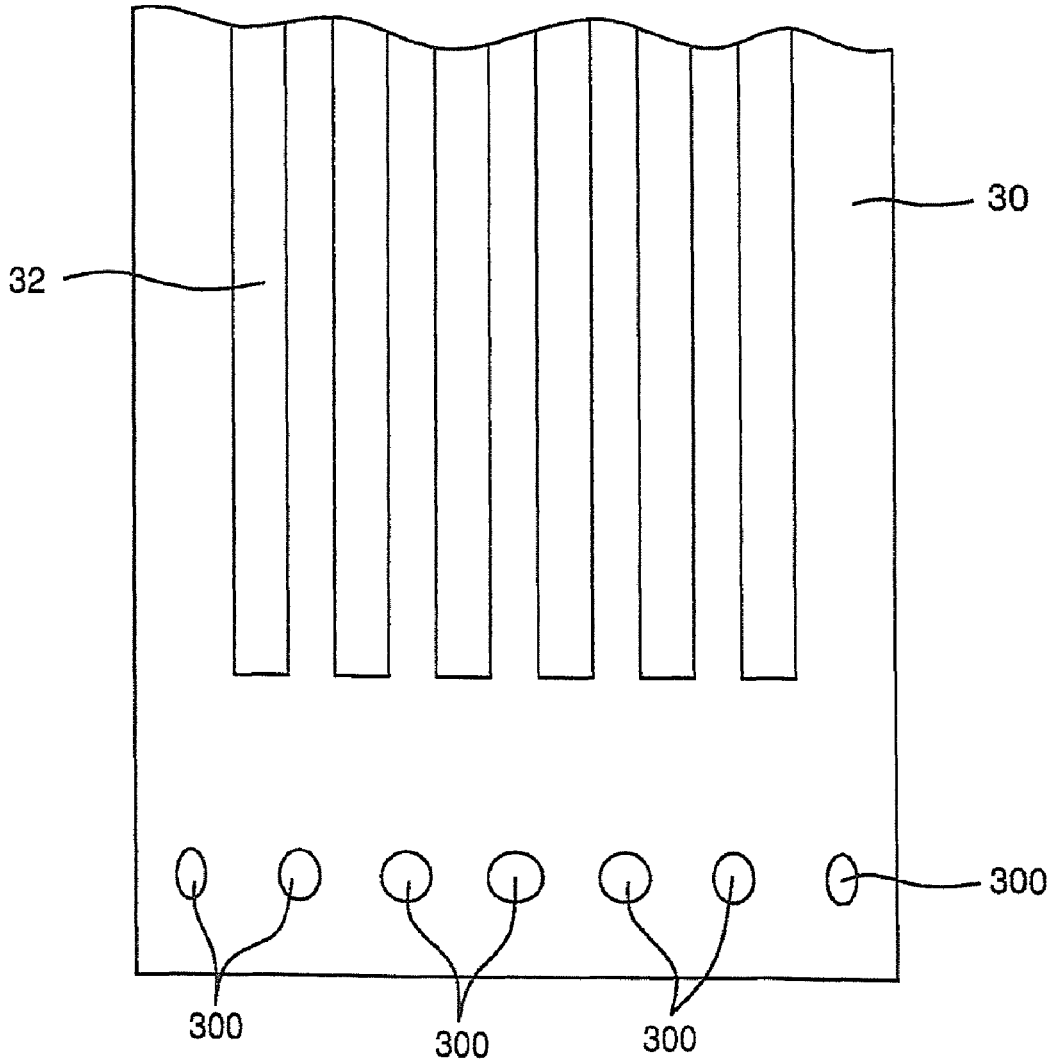
FIG. 9 is a side view of a lower portion of filter sleeve 30, comprising the ports of the secondary by-pass system.
Figure 10:
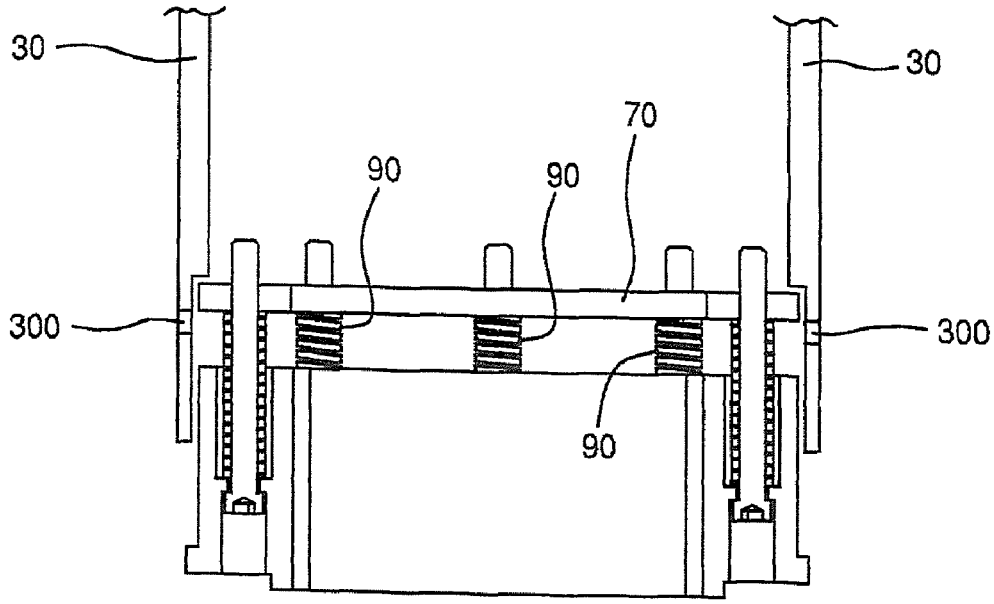
FIGS. 10 and 11 are views of various components of the secondary by-pass system, with the filter sleeve and seat in their upper and lower positions.

The secondary bypass, in that situation, permits fluids (and generally the contents of chamber 80) to flow out of chamber 80, thereby by-passing the filtering aspect of the tool. Secondary by-pass system comprises a plurality of ports 300, preferably spaced around the periphery of filter sleeve 30 proximal its lower end. FIG. 9 shows filter sleeve 30 with such ports 300. In FIG. 10, detail is shown of the lower end of filter sleeve 30 comprising ports 300, in a first position. In that position, seat 70 is in an upward position, and blocks flow through ports 300 (whether solids or fluids).

Figure 11:
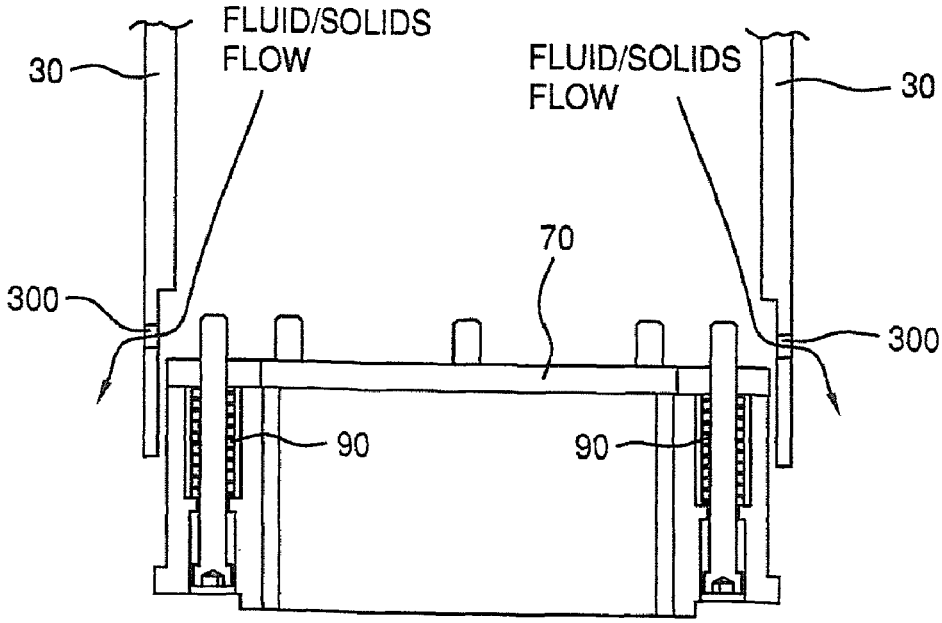

However, when filter sleeve 30 cannot move downward with respect to mandrel 20, yet downward fluid forces exist (which, as described above, may tend to damage filter tool 10 or other equipment), then said fluid forces act on seat 70, and move seat 70 to the position in FIG. 11. As can be seen in the drawing, seat 70 is then moved below ports 300, opening ports 300 to flow. Now, fluids and/or any solids contained in chamber 80 can flow out of chamber 80, thereby relieving the "locked" situation described above.

Materials

As is known to those having ordinary skill in the relevant art, various materials may be used to make the present invention. Typically, high strength steels and alloys thereof are used for many parts. Certain parts, such as wiper 50, as described above may be made of a resilient material, such as rubber, elastomers, etc., or may be steel or synthetic bristles It is understood that the present invention encompasses the apparatus made of any suitable materials.

Conclusion

While the preceding description contains many specificities, it is to be understood that same are presented only to describe some of the presently preferred embodiments of the invention, and not by way of limitation. Changes can be made to various aspects of the invention, without departing from the scope thereof. For example, dimensions can be altered to suit particular applications. In lieu of slots 32 in filter sleeve 30, other openings such as holes, etc. can be used. The size of slots 32, or other fluid openings, may be varied to suit different applications. Different materials may be used for the various components.

Therefore, the scope of the invention is to be determined not by the illustrative examples set forth above, but by the appended claims and their legal equivalents.

We claim:

1. An apparatus for connection in a tubing string for use at a subterranean location in a wellbore to filter solids from fluids located in a wellbore annulus formed between the tubing exterior and wellbore wall interior, the apparatus comprising:

a) a mandrel forming a central passageway there through; connectors on said mandrel for connecting said mandrel to a tubing string in fluid communication with the interior of said tubing string;

b) a diverter sleeve mounted exterior of said mandrel, forming an inner diverter annulus between said mandrel and said diverter sleeve;

c) a filter sleeve mounted exterior of said mandrel, forming an interior filter annulus between said mandrel and said filter sleeve, said interior filter annulus is open at one end to receive fluids, said filter sleeve having a filter opening of a size to provide a flow path for wellbore fluids to flow between said interior filter annulus and said wellbore annulus and said filter opening being of a size and shape to prevent solids from flowing from said interior filter annulus; and d) said filter sleeve mounted to move axially with respect to said mandrel between a bypass position, wherein said one end of said filter sleeve is spaced away from said diverter sleeve to form an axially extending gap whereby fluid flowing into said interior diverter annulus flows through said gap to bypass said filter sleeve and closed position, wherein said one end of said filter sleeve contacts said diverted sleeve to close said gap, whereby fluid flowing into said interior diverter annulus flows into said interior filter sleeve annulus and through said filter openings.

2. The apparatus of claim 1, additionally comprising an outer member on said diverter sleeve and, wherein said member being of a size to engage said wellbore wall.

3. The apparatus of claim 2, wherein said diverter sleeve has a radially extending port in its wall and, wherein said port is located on the opposite side of the outer member from the filter sleeve.

4. The apparatus of claim 1, additionally comprising a resilient member, contacting said filter sleeve and urging said filter sleeve to move in an axial direction toward said closed position.

5. The apparatus of claim 1, wherein said filter sleeve is mounted to rotate with respect to said mandrel.

6. The apparatus of claim 1, wherein said diverter sleeve is mounted to rotate with respect to said mandrel.

7. The apparatus of claim 2, wherein said member on said diverter sleeve comprises a wiper.

8. The apparatus of claim 2, wherein said member on said diverter sleeve comprises a brush.

9. The apparatus of claim 1, wherein said filter opening in said filter sleeve comprises a slot.

10. The apparatus of claim 1, wherein said connectors on said mandrel comprises threads.

11. The apparatus of claim 1, additionally comprising a stabilizer disposed on said mandrel.

12. The apparatus of claim 1, wherein said diverter sleeve is mounted on said mandrel to move longitudinally between a closed position, contacting said one end of said filter sleeve and another position, wherein said diverter sleeve is spaced away from said one end of said filter sleeve when said sleeve is in said closed position.

13. The apparatus of claim 1, additionally comprising a discharge passageway adjacent said other end of said interior filter annulus, said discharge passageway connecting said interior filter annulus and said wellbore annulus and said discharge passageway being of a size and shape to flow wellbore fluids and solids from said interior filter annulus into said wellbore annulus; and a valve member operably associated with said filter sleeve for movement between a first position, blocking flow through said passageway and a second position, permitting flow to discharge fluids and solids from said interior filter annulus.

14. The apparatus of claim 13, wherein said passageway is a port in said filter sleeve.

15. The apparatus of claim 13, additionally comprising a resilient member urging said valve member toward and into said first position.

16. The apparatus of claim 15, wherein said resilient member is a spring.

17. The apparatus of claim 1, wherein said diverter sleeve has a radially extending port in its wall.

* * * * *